US006126275A

United States Patent [19]

Kagayama

[11] Patent Number: 6,126,275

[45] Date of Patent: Oct. 3, 2000

[54] RECORDING ELECTRODE BODY, METHOD OF MANUFACTURING A RECORDING ELECTRODE BODY, AND IMAGE FORMING APPARATUS USING A RECORDING ELECTRODE BODY

[75] Inventor: Shigeru Kagayama, Owariasahi, Japan

[73] Assignee: Brother Kogyo Kabushiki Kaisha, Nagoya, Japan

[21] Appl. No.: 09/151,283

[22] Filed: Sep. 11, 1998

[30] Foreign Application Priority Data

Sep. 12, 1997 [JP] Japan ..... 9-248280

[51] Int. Cl.[7] ..... B41J 2/04

[52] U.S. Cl. ..... 347/55

[58] Field of Search ..... 347/55, 120, 123, 347/111, 159, 141, 128, 17, 103, 154; 216/13, 23, 80; 438/166, 161

[56] References Cited

U.S. PATENT DOCUMENTS 3,689,935 9/1972 Pressman et al. .

5,504,509 4/1996 Kagayama .

5,552,814 9/1996 Maeda et al. .

5,631,679 5/1997 Kagayama .

5,851,860 12/1998 Makita et al. ..... 438/166

FOREIGN PATENT DOCUMENTS 6-155798 6/1994 Japan .

*Primary Examiner*—John Barlow

*Assistant Examiner*—Raquel Yvette Gordon

*Attorney, Agent, or Firm*—Oliff & Berridge, PLC

[57] ABSTRACT

Driver ICs are formed from low-temperature polycrystal silicon directly on an insulating sheet of a recording electrode body by forming a thin film of amorphous silicon, polycrystallizing the amorphous silicon by using excimer laser, and converting the polycrystallized silicon into a semiconductor circuit. Therefore, the step of mounting driver ICs on the insulating sheet is obviated. It becomes possible to produce a recording head and an image forming apparatus having a high resolution and a high reliability.

18 Claims, 7 Drawing Sheets

RECORDING ELECTRODE BODY, METHOD OF MANUFACTURING A RECORDING ELECTRODE BODY, AND IMAGE FORMING APPARATUS USING A RECORDING ELECTRODE BODY

BACKGROUND OF THE INVENTION

1. Field of the Invention

The invention relates to a recording electrode body for use in an image forming apparatus that forms an image by controlling an electric field, and that can be used in a copier, a printer, a plotter, a facsimile or other similar device. The invention also relates to a method of manufacturing a recording electrode body, and an image forming apparatus that uses the recording electrode body.

2. Description of the Related Art

U.S. Pat. No. 3,689,935 discloses an image forming apparatus that applies image signals to an electrode, that defines apertures, to control the passage of toner particles through the apertures so as to form a desired image on a support body.

The image forming apparatus described in U.S. Pat. No. 3,689,935 includes an aperture electrode body made up of an insulating layer, a continuous shield electrode disposed on one side of the insulating layer, and a plurality of separate control electrodes disposed on the other side of the insulating layer. The control electrodes are insulated from one another. The aperture electrode body has at least one row of apertures, each of which extends through the three layers, that is, the shield electrode, the insulating layer and the control electrodes, on a one-to-one correspondence with the separate control electrodes.

The image forming apparatus further includes a device that selectively provides an electric potential to the control electrodes relative to the shield electrode, a device that supplies charged toner particles to the apertures of the aperture electrode body, a back-plate electrode which is disposed on a side of the support body that is opposite from the aperture electrode body, and to which a high voltage is applied, and a device that positions the support body in a particle passage by moving the support body relative to the aperture electrode body.

The present applicant has proposed in, for example, Japanese Patent Application Laid-Open No. HEI 6-155798, an improved image forming apparatus in which the recording characteristics are considerably improved by disposing a carrier, that carries toner thereon, and an aperture electrode body, so that they are in contact with each other.

The recording head used in this image forming apparatus is illustrated in FIG. 1. A recording head 100 includes an insulating sheet 102 formed of, for example, a polyimide film of 25 to 50 microns in thickness, and a substrate 101 disposed thereon. The substrate 101 has leads 103 that are formed of a copper layer of 8 microns in thickness. Driver ICs 105 are provided on the substrate 101. Multiple apertures 106 are formed near a distal end of the leads 103. Since the apertures 106 are aligned in a straight line at a high density, the apertures 106 are illustrated as a straight line in FIG. 1.

Each of the driver ICs 105 applies an output voltage to the leads 103 so as to form a control electric field around the corresponding aperture 106. Each driver IC 105 is an ordinary IC that is formed mainly from silicon, and that has a logic portion and a driver portion.

However, the above-described recording head is limited from the stand point of miniaturizing the apparatus and reducing its production cost. Specifically, in order to provide a higher resolution of the recording head, it is important to take into account how densely the components of the recording head, such as the apertures of the printing portion, the control electrodes, the driver ICs and other components, can be arranged in the lengthwise direction, that is, how narrow each component can be formed in that direction.

With regard to the apertures and the control electrodes, a processing technology for achieving a pitch of 40 $\mu$m or less has been developed. With regard to the driver ICs, advancements in the semiconductor technology have made it possible to achieve a pad pitch of about 40 $\mu$m, that is, voltage electrode output pin pitch of about 40 $\mu$m.

However, there is a significant problem in a mounting technology for connecting the driver ICs to the control electrodes on the substrate. In particular, the mounting of driver ICs at such a reduced pad pitch cannot be achieved according to the conventional technology.

This problem occurs because the wire bonding method that is normally used merely provides pin connection at a pitch of about 70 microns or greater, Furthermore, since only one lead wire can be connected at a time by the wire bonding method, the connecting process requires a lot of labor and high costs, especially for products that have many pin connections, for example, a high-resolution head.

In a recently developed mounting method that is generally referred to as the flip chip mounting method, ICs are joined with a substrate, facing down. Since the method joins all the leads of each IC to the substrate by one process, the flip chip mounting method can reduce costs. However, the connection pitch that can be practically achieved by this method is only about 100 microns. Therefore, this method cannot be applied to high-resolution recording heads.

However, regardless of which conventional method is employed, there is a significant possibility that a connection will fail since a lot of connections must be formed. Therefore, the conventional mounting methods also have a reliability problem.

SUMMARY OF THE INVENTION

Accordingly, it is an object of the invention to provide a recording head for an image forming apparatus that allows a higher resolution to be achieved, has a high reliability, provides for faster output, and allows production costs to be reduced. It is also an object of the invention to provide an image forming apparatus that uses such a recording head.

According to one aspect of the invention, a recording electrode body is disposed between a charged particle supply device that supplies charged particles and a back-plate electrode device that draws the charged particles. The recording electrode body restricts the flight of the charged particles supplied by the charged particle supply device. The recording electrode body includes an insulating sheet, a plurality of apertures formed in the insulating sheet so that the charged particles can pass through the apertures, a control electrode that controls the passage of the charged particles through the apertures by using an electric field, and a driver IC disposed directly in the insulating sheet. The driver IC controls the production of the electric field by the control electrode.

In the recording electrode body of the invention, it is possible to form driver ICs directly at a desired site. Therefore, the recording electrode body obviates a step of mounting IC in accordance with the conventional art. Consequently, the production costs can be reduced. Furthermore, the problem of a connection failure in the mounting step of the conventional art is eliminated, thereby improving reliability. Further, since fine, precise and reliable connection is achieved without using a conventional Connecting method, such as wire boding or a similar method, the recording electrode body can be reduced in size and improved in resolution.

The driver IC may be formed from a low-temperature polycrystal silicon. Therefore, high-speed output processing is provided, so that a recording head with a high-speed output ability can be realized.

The driver IC may send the control electrode an electrical signal corresponding to information to be recorded, and may be formed on the insulating sheet. In this structure, the plurality of apertures (recording material passage portions), the control electrodes corresponding to the individual apertures, and the driver ICs for selectively sending electric signals to the control electrodes, are all incorporated as a single unit in the insulating substrate. Therefore, a miniaturized multi-recording head that is capable of high-speed output can be provided.

The control electrode or the plurality of apertures may be provided in the insulating sheet at a density of at least 250 dpi. With this structure, the recording electrode body will enable a recording head with high-density and high-resolution printing ability to be provided. Furthermore, it is also become possible to reduce the size of the apparatus and achieve high-quality image output.

The driver IC may be a driver IC formed from the low-temperature polycrystal silicon by forming a thin film of an amorphous silicon on the insulating sheet, polycrystallizing the thin film of the amorphous silicon, and converting the polycrystallized amorphous silicon into a semiconductor circuit.

Furthermore, the insulating sheet may be formed from a polyimide resin, and the charged particles may be toner particles.

According to another aspect of the invention, an image forming apparatus includes a charged particle supply device that supplies charged particles, a back-plate electrode device that draws the charged particles, and a recording electrode body disposed between the charged particle supply device and the back-plate electrode device. The recording electrode body restricts the flight of the charged particles supplied by the charged particle supply device. The recording electrode body includes an insulating sheet, a plurality of apertures formed in the insulating sheet so that the charged particles can pass through the apertures, a control electrode that controls passage of the charged particles through the apertures by using an electric field, and a driver IC disposed directly in the insulating sheet. The driver IC controls the production of the electric field by the control electrode.

This image forming apparatus is designed so that a portion of the recording electrode body that is in the vicinity of the apertures elastically contacts a portion of the charged particle supply device, which may be a member for transporting the charged particles to the recording electrode body in a preferred embodiment. Due to this elastic contact, the charged particles in the charged particle supply device receive mechanical force, and therefore roll at the contact site. The rolling of the charged particles reduces the force of attaching the particles to the charged particle supply device, so that the charged particles become more prone to be affected by other forces. As a result, it becomes possible to efficiently control the passage of the charged particles in the vicinity of the apertures by using a reduced control voltage. Consequently, the structure for controlling the passage of the charged particles can be simplified, the size of the entire apparatus can be reduced, and the manufacturing costs can be reduced.

In the image forming apparatus, the driver IC may be formed from a low-temperature polycrystal silicon.

According to still another aspect of the invention, a method of manufacturing a recording electrode is provided. A recording electrode body is disposed between a charged particle supply device that supplies charged particles and a back-plate electrode device that draws the charged particles. The recording electrode body restricts the flight of the charged particles supplied by the charged particle supply device. A control electrode is formed in an insulating sheet. A thin film of an amorphous silicon is formed on the insulating sheet. The thin film of the amorphous silicon is polycrystallized. The polycrystallized amorphous silicon is converted into a semiconductor circuit.

The method for producing a recording electrode body may further include the step of forming a plurality of apertures in the insulating sheet.

BRIEF DESCRIPTION OF THE DRAWINGS

A preferred embodiment of the invention will be described in detail with reference to the following figures wherein.

DETAILED DESCRIPTION OF PREFERRED EMBODIMENT

A preferred embodiment of the invention will be described in detail hereinafter with reference to the accompanying drawings.

Figure 3:
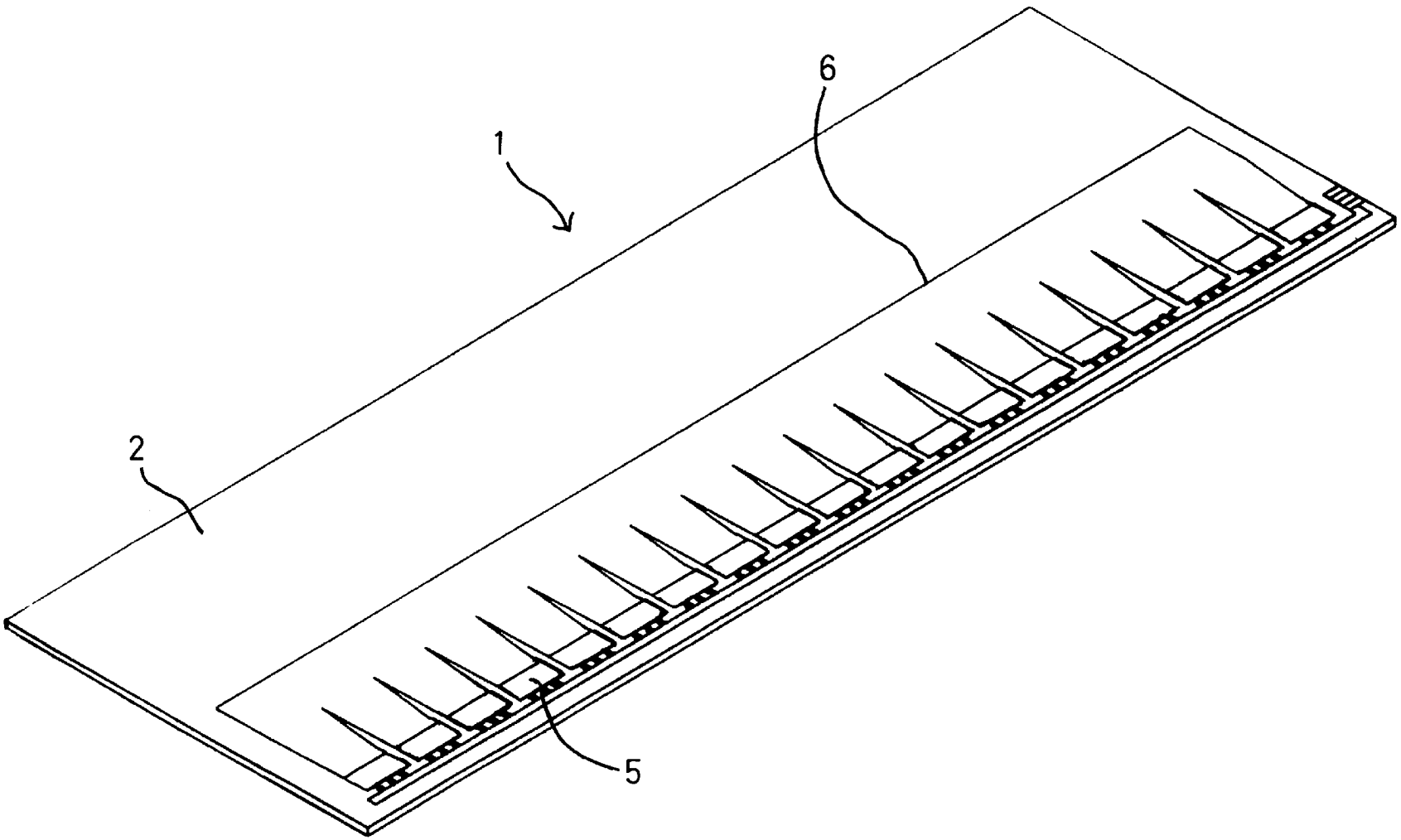
FIG. 3 is a perspective view of an aperture electrode body according to an embodiment of the invention.
Figure 4:
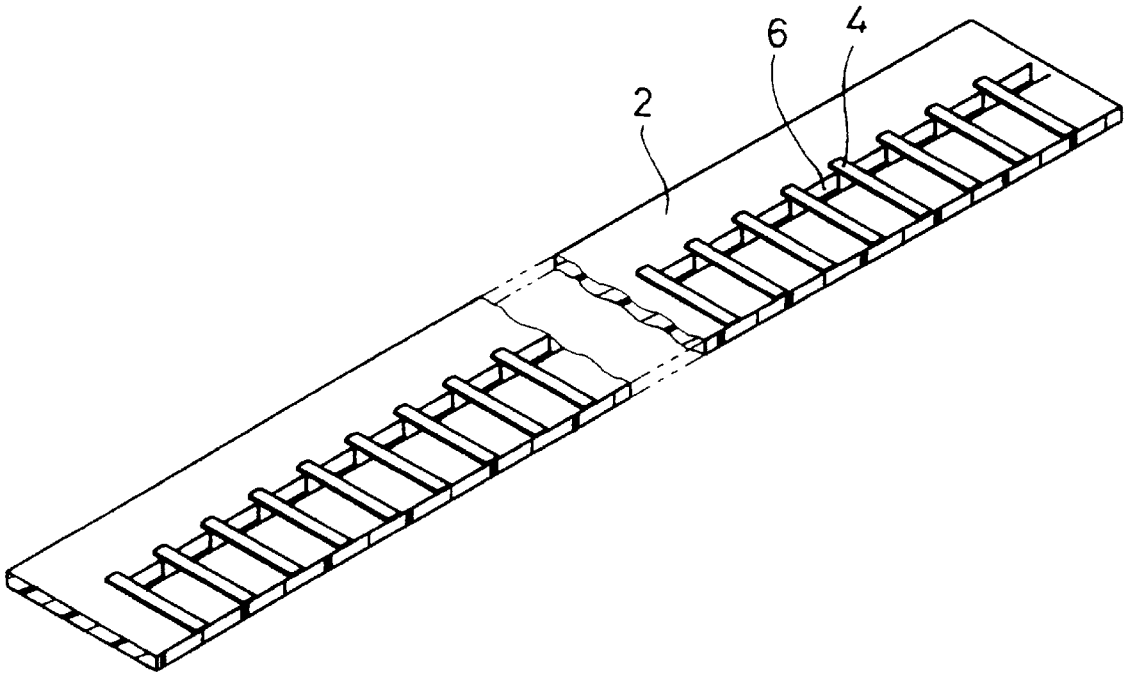
FIG. 4 is an enlarged perspective view of a portion of the aperture electrode body around an aperture according to the embodiment of the invention.
Figure 5:
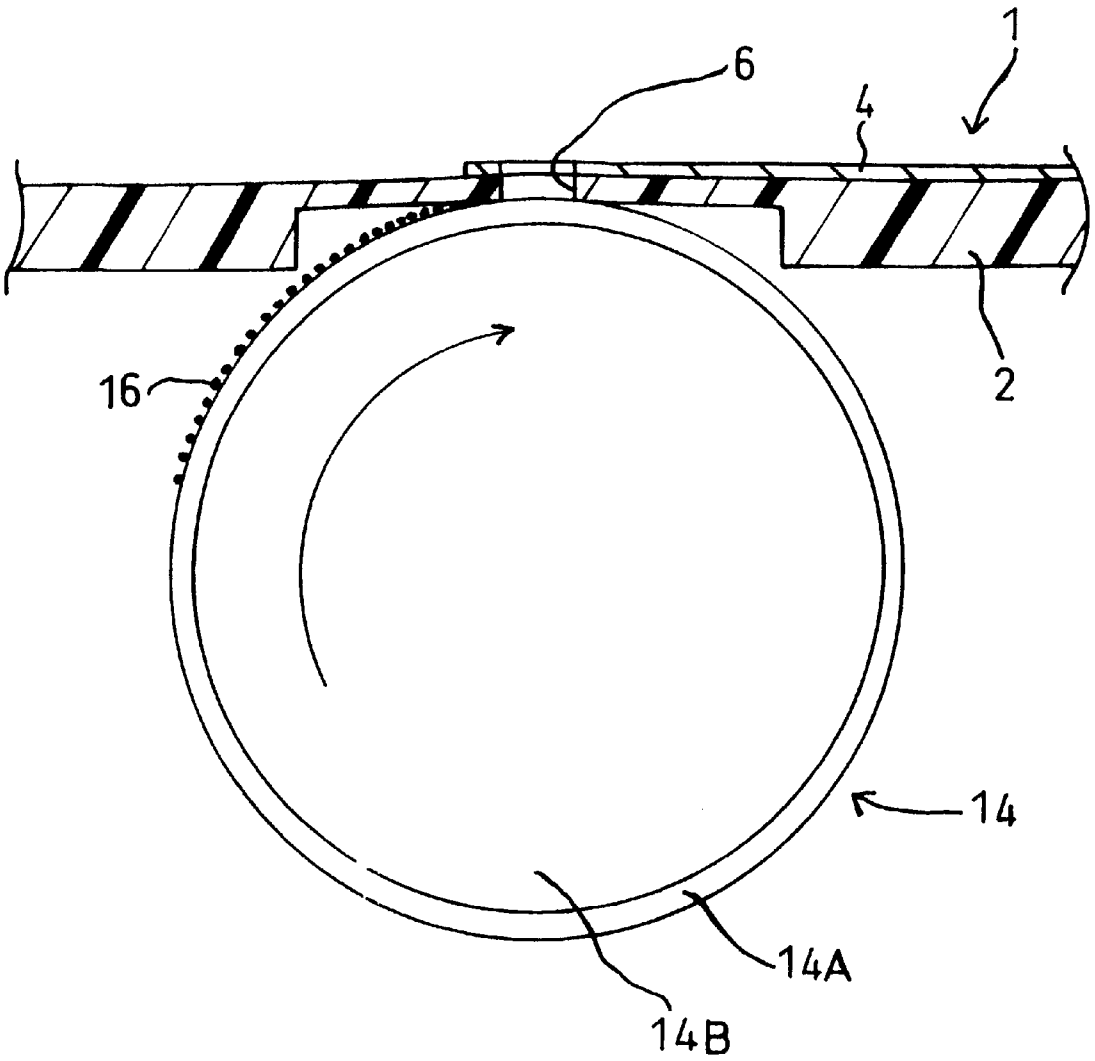
FIG. 5 illustrates a positional relationship between a toner carrying roller and the aperture electrode body according the embodiment of the invention.

An aperture electrode body 1 corresponding to the recording electrode body of the invention is illustrated in FIGS. 3, 4 and 5. FIG. 3 is a perspective view of the aperture electrode body 1. FIG. 4 is an enlarged view of a portion of the aperture electrode body around an aperture. FIG. 5 illustrates a positional relationship between the aperture electrode body 1 and a toner carrying roller 14.

The aperture electrode body 1 has a substrate that is formed by a polyimide-made insulating sheet 2 having a thickness of 25 to 50 $\mu$m. Driver integrated circuits (ICs) 5 are formed on the insulating sheet 2. The driver ICs 5 are formed of low-temperature polycrystal silicon. A plurality of apertures 6 and a plurality of control electrodes 4, that are connected to the driver ICs 5 and that correspond to the individual apertures 6, are also formed on the insulating sheet 2.

The apertures 6 are equidistantly aligned in a row substantially on a center line of the aperture electrode body 1. Each aperture 6 extends through the insulating sheet 2, and has a generally rectangular shape of 65 μm×80 μm. The apertures 6 correspond to a recording material passage for passing a recording material, i.e., toner in this embodiment.

The control electrodes 4, for controlling toner flow, extend on an upper surface of the insulating sheet 2, along two sides of each aperture 6. The control electrodes 4 have a thickness of 8 μm and a line width of 20 μm. The apertures 6 and the control electrodes 4 are arranged at a pitch of 85 μm corresponding to a resolution of 300 dpi (dots per inch). The control electrodes 4 are connected to the corresponding driver ICs 5.

A portion of the insulating sheet 2 around the apertures 6 is reduced in thickness, to no more than 25 μm by removing a side portion of the portion around the apertures 6 opposite from the control electrodes 4. This removal can be performed by spot facing or counter sinking so as to improve the controllability for the reason discussed below.

When the aperture electrode body 1 is disposed in an image forming apparatus, the counter-sunk surface of the aperture electrode body 1 is brought into contact with a portion of a recording material supply device, preferably, a portion of a member (that is, the toner carrying roller 14) for transporting the recording material (toner) to the apertures 6 formed in the insulating sheet 2. In this image forming apparatus, the passage of the recording material through the apertures 6 is controlled by using electric fields produced in the individual apertures 6 by the electric potential difference between the control electrodes 4 and the surface of the toner carrying roller 14 (normally, grounded). Therefore, as the contact portion of the insulating sheet 2 is reduced in thickness, the control voltage needed for each control electrode 4 to produce a sufficiently strong electric field is reduced, so that the controllability correspondingly improves.

Figure 1:
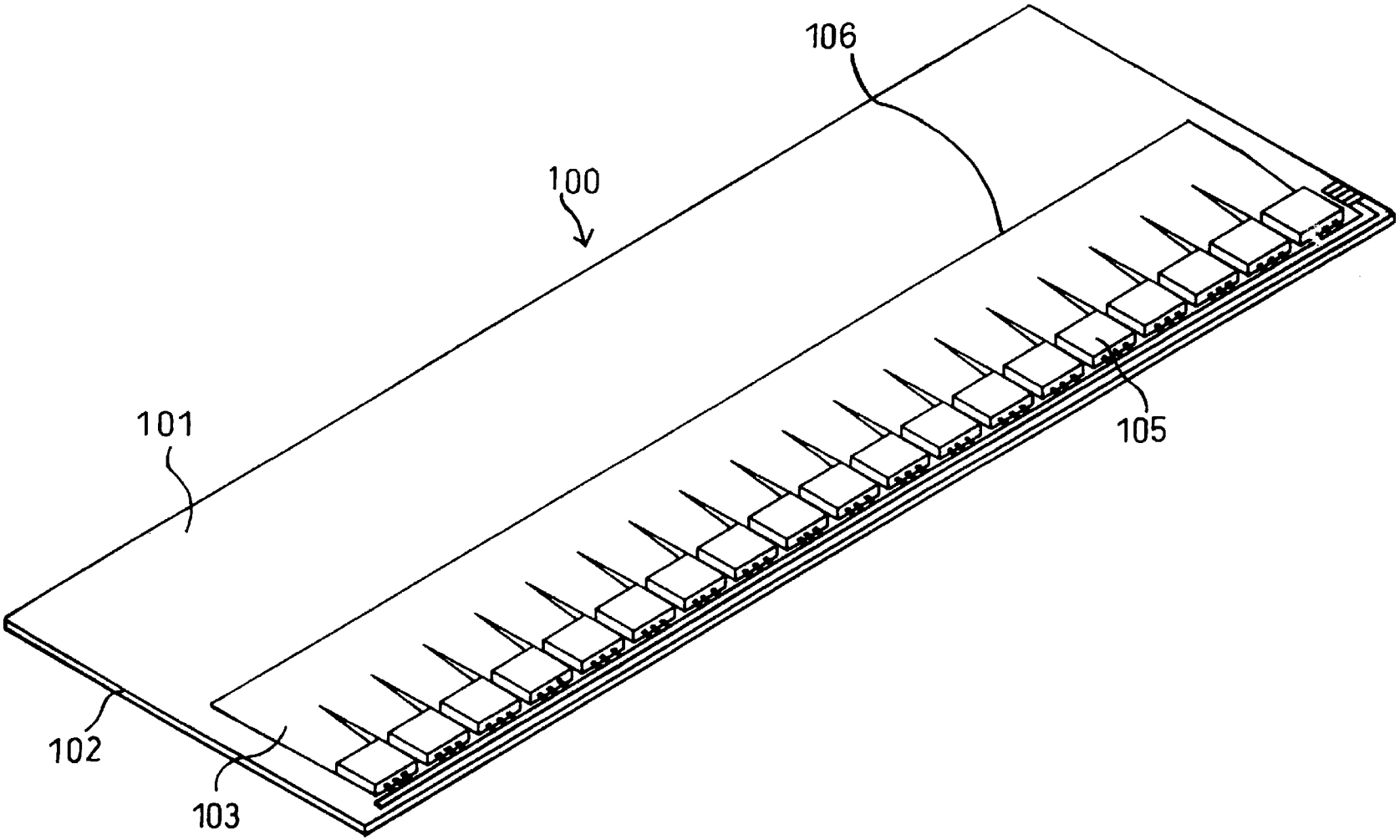
Fig. 1 RELATED ART
FIG. 1 is a perspective of view of a conventional aperture electrode body.
Figure 2:
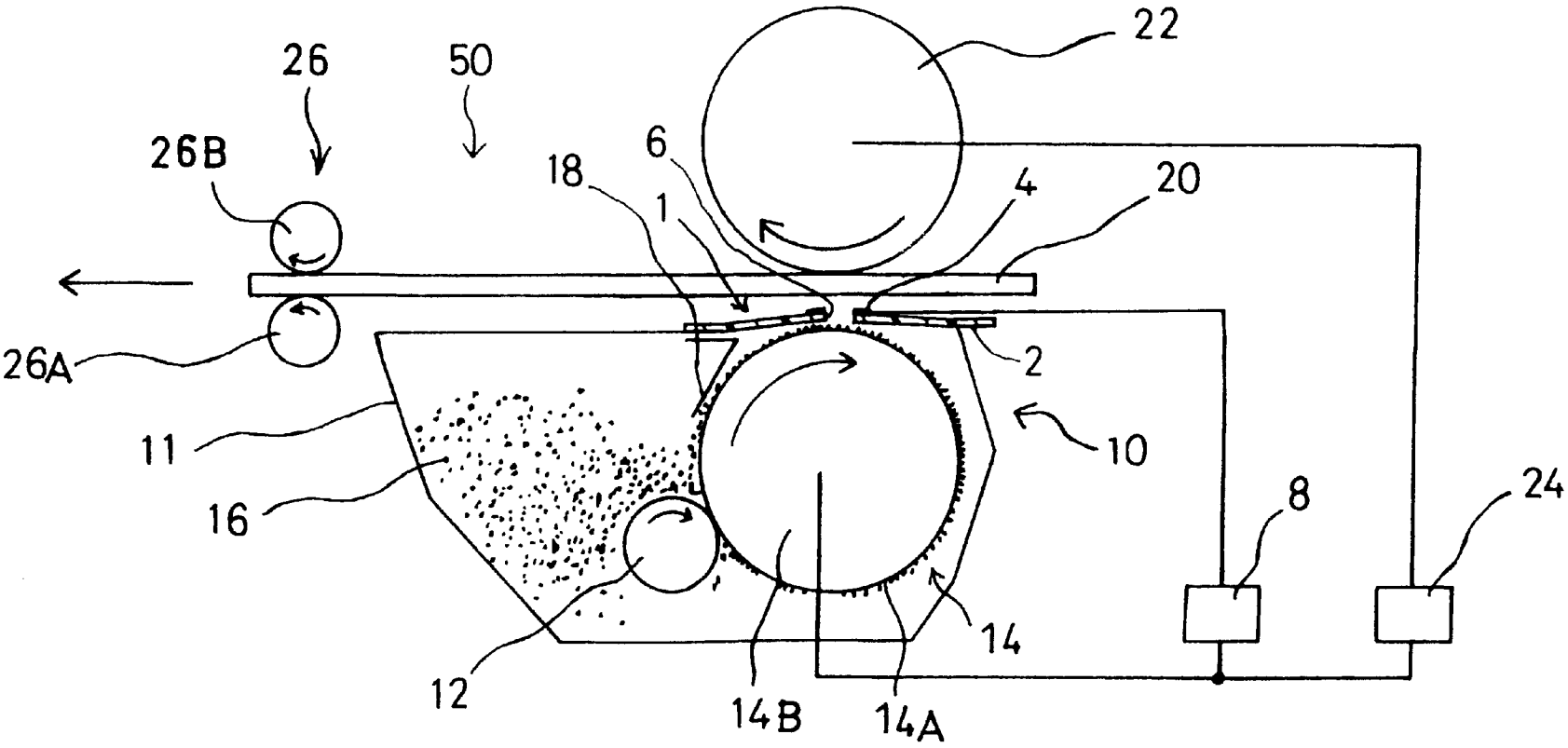
FIG. 2 is a sectional view of an image forming apparatus using a recording head according to the invention.

As illustrated in FIG. 2, the aperture electrode body 1 is disposed in such a manner that a surface of the insulating sheet 2 provided with the control electrodes 4 faces a recording medium 20, and the opposite-side surface thereof, which is not provided with the control electrodes 4, contacts toner particles carried on the toner carrying roller 14 described below.

The insulating sheet 2 is flexible, and it is slightly curved along an outer peripheral surface of the toner carrying roller 14 by the toner carrying roller 14 pressing the insulating sheet 2. Such a curved aperture electrode body is described in U.S. Pat. Nos. 5,504,509, 5,631,679, and 5,552,814. The descriptions thereof are incorporated by reference herein.

Figure 6:
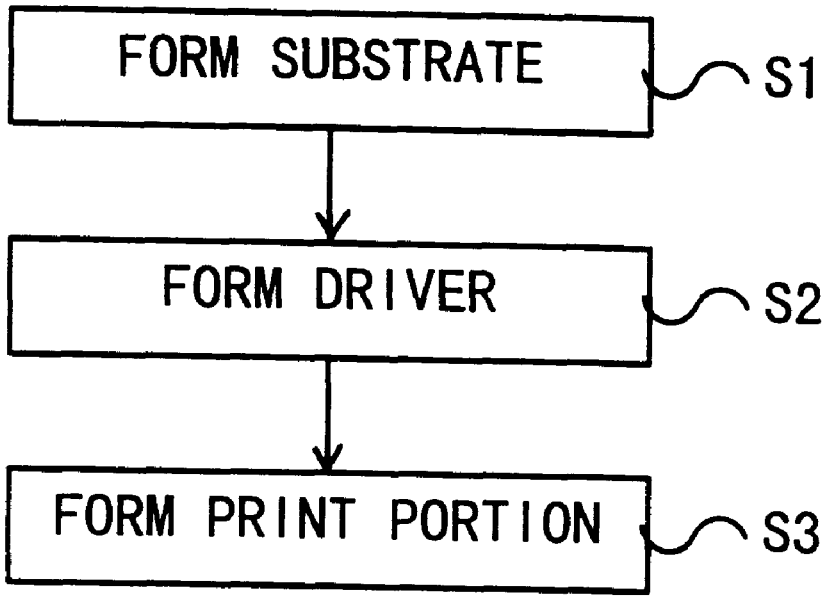
FIG. 6 illustrates steps for forming the aperture electrode body according to the embodiment of the invention.
Figure 7:
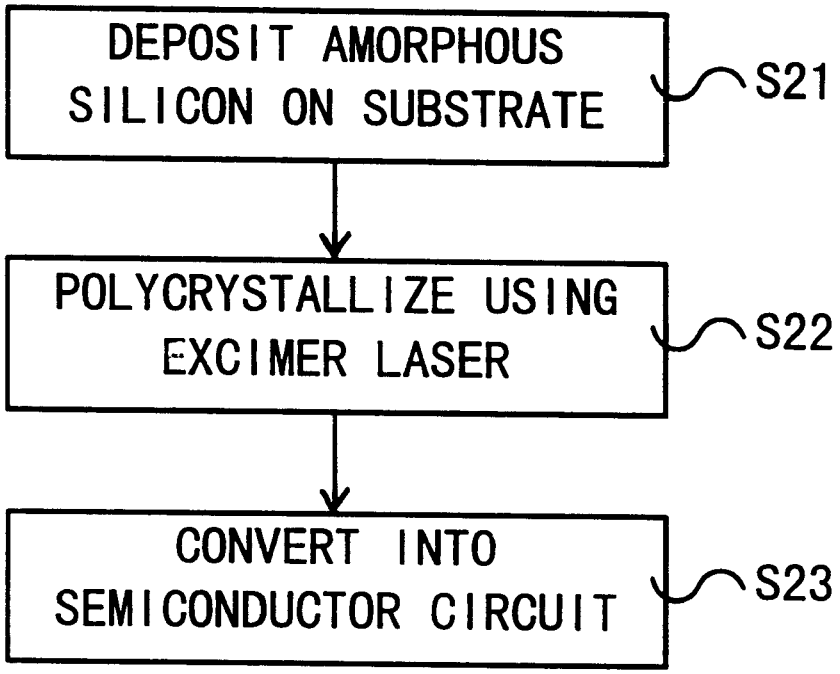
FIG. 7 illustrates in detail a step of forming drivers on the aperture electrode body according to the embodiment of the invention.

The method of manufacturing an aperture electrode body that has driver ICs thereon that are formed of low-temperature polycrystal silicon is described with reference to FIGS. 6 and 7. FIG. 6 is a schematic flowchart illustrating the method of forming the aperture electrode body 1 of the embodiment of the invention. The method is roughly divided into three steps: a substrate forming step S1, a driver forming step S2 and a printing portion forming step S3. FIG. 7 illustrates the driver forming step S2 in detail.

The substrate forming step S1 is generally referred to as a TAB tape step. In this step, a copper film is formed on the insulating sheet 2 formed by a polyimide resin substrate. A photo-sensitive resist is applied to the copper film on the insulating sheet 2. After the photo-sensitive resist is exposed to a pattern including the control electrodes 4, the resist is developed. Subsequently, portions not covered with the resist that remain are etched by ferric chloride, thereby forming a pattern. The substrate forming step S1 is thus completed.

The driver forming step S2 includes a thin film forming step S21 in which amorphous silicon is deposited on the substrate formed in the substrate forming step S1, a polycrystallizing step S22 in which annealing is performed by using an excimer laser, and a semiconductor circuit forming step S23 in which polysilicon patterning, deposition of gate portions and the like are performed. As the main fabrication in the driver forming step S2, an amorphous silicon film is formed on the substrate by a chemical vapor deposition (CVD) method in step S21, and the amorphous silicon film is irradiated with an excimer laser of KrF (krypton fluoride) having a wavelength of 248 nm for annealing, thereby converting the amorphous silicon into polycrystal silicon in step S22. The annealing is performed at an energy density of 260 mJ/cm$^2$ and a substrate temperature of about 200° C. As a result, lower-temperature polycrystal silicon, which will be formed into the driver ICs 5, is formed on the substrate so that it is directly electrically connected to the wiring pattern formed in the substrate forming step S1.

Subsequently in the printing portion forming step S3, a plurality of through-holes that will be formed into the apertures 6 are formed in the substrate (the insulating sheet 2), at a predetermined position at a predetermined pitch. The aperture electrode body 1 is thus formed.

The driver ICs 5 provided on the aperture electrode body 1 are formed from low-temperature polycrystal silicon, which is a feature of the invention. Low-temperature polycrystal silicon will be described below.

For example, the thin film transistors (TFTs) of a TFT liquid crystal display (LCD), that is a widely-used conventional LCD, are formed from amorphous silicon. Due to its irregular crystal structure, the amorphous silicon has a very low electron mobility. Therefore, in the case of LCDs, the use of amorphous silicon is substantially limited to TFTs, which are simple switches for turning on and off the liquid crystal on a glass base board. In a thin film formed of low-temperature polycrystal silicon, however, the electron mobility can be enhanced to more than one hundred times that in amorphous silicon. Therefore, using the low-temperature polycrystal silicon, driver ICs that need to perform high-speed processing can also be formed on an LCD panel.

An image forming apparatus equipped with the recording head as described above is described with reference to the drawings.

FIG. 2 is a schematic illustration of an image forming apparatus 50 equipped with the aperture electrode body 1 according to the embodiment of the invention. In the image forming apparatus 50 of the embodiment, a cylindrical back-plate electrode roller 22 that functions as a back-plate electrode is disposed above the aperture electrode body 1, with a gap of 1 mm therebetween. The back-plate electrode roller 22 is rotatably supported by a case (not shown). The back-plate electrode roller 22 is designed to convey an image recording medium 20 (more specifically, a recording sheet or film) inserted into the gap.

A toner supply device 10 corresponding to a recording material supply device extends below the aperture electrode body 1, in the direction of length of the aperture electrode body 1. Rotatable conveying rollers (not shown) are disposed at the incoming side of the aperture electrode body 1 for conveying the image recording medium 20 into the gap between the back-plate electrode roller 22 and the aperture electrode body 1. A fixation device 26 is disposed down the conveyance path of the image recording medium 20 from the back-plate electrode roller 22.

The components of the image forming apparatus 50 will be described in detail. The toner supply device 10 is substantially made up of a toner case 11 that also serves as a housing of the toner supply device 10, toner 16 (recording material) contained in the toner case 11, a supply roller 12, the toner carrying roller 14 that serves as a toner carrier, and a toner layer restriction blade 18.

As shown in FIG. 5, the toner carrying roller 14 is substantially made up of a central shaft 14B formed of an electrically conductive metallic material, and a surface layer 14A that is formed, as a roller surface, on an outer peripheral surface of the central shaft 14B. The surface layer 14A is formed of a rubber that has a semi-conductivity or a conductivity. The surface layer 14A carries thereon a layer of toner 16 and thereby transports it to the aperture electrode body 1.

The supply roller 12 has a surface layer that is formed of a sponge or a foamed rubber of urethane, silicon or other similar material. The supply roller 12 supplies toner 16 from the toner case 11 to the toner carrying roller 14. The supply roller 12 and the toner carrying roller 14 are supported in the toner case 11 so that they are rotatable in the directions indicated by arrows in FIG. 2. The supply roller 12 and the toner carrying roller 14 are disposed in contact with each other so as to charge toner 16 with a predetermined polarity, for example, positive polarity, by friction, which thereby causes the toner 16 to be carried on the surface layer 14A of the toner carrying roller 14.

The toner layer restriction blade 18 adjusts the amount of toner 16 carried on the toner carrying roller 14 so as to thinly and evenly spread toner 16 over the roller surface. The toner layer restriction blade 18 also serves to uniformly charge the toner 16 on the toner carrying roller 14. The toner layer restriction blade 18 is in pressed contact with the toner carrying roller 14.

The aperture electrode body 1 and the toner carrying roller 14 are disposed so as to press each other with a constant force. The aperture electrode body 1 is flexible so as to extend along the surface of the toner carrying roller 14. A portion of the aperture electrode body 1 around the apertures 6 that extends through the insulating sheet 2 contacts toner 16 on the toner carrying roller 14 as shown in FIG. 5, while the control electrodes 4 face the image recording medium 20. The insulating sheet 2 is slightly curved so as to extend along the surface of the toner carrying roller 14.

When a control voltage of, for example, +20 V, is applied to a control electrode 4, an electric field is produced between the control electrode 4 and the surface layer 14A, whose surface electric potential is set to about 0 V by the grounded central shaft 14B. Therefore, toner 16 transported to the corresponding aperture 6, where the electric field is produced, receives an electrostatic force in the direction toward the control electrode 4. However, toner 16 is attached to the surface layer 14A with a considerable strength due to the image force caused by the charge of the toner 16, a physical adsorbing force, and the like. Therefore, the electrostatic force in the aperture 6 alone is not sufficient to overcome the attaching force to fly toner 16 toward the control electrode 4.

Due to the elastic contact between the insulating sheet 2 and the toner carrying roller 14, the toner 16 on the toner carrying roller 14 receives a mechanical force so that toner 16 rolls at the contact portion. The rolling of toner 16 forms a small gap between the toner 16 and the surface layer 14A, thereby sharply reducing the attaching force. Thus, the passage of toner 16 through the apertures 6 can be controlled by the electrostatic force produced in the apertures 6 even if the control voltage is relatively low.

A control voltage applying circuit 8 that applies a control voltage is connected to the aperture electrode body 1 by a harness or similar device. Based on image data inputted from an image data input portion (not shown), the control voltage applying circuit 8 controls the driver ICs 5 mounted on the aperture electrode body 1, and selectively applies +20 V (on-voltage) or −20 V (off-voltage) to the individual control electrodes 4. The image data input portion is connected to an external computer, an image scanner, an image communication device and other similar devices.

The back-plate electrode roller 22 is disposed facing the toner carrying roller 14, with the portion of the aperture electrode body that defines the apertures 6 positioned therebetween. As described above, the back-plate electrode roller 22 is spaced about 1 mm from the aperture electrode body 1, and rotatably supported by a chassis (not shown). Therefore, it is possible to insert the image recording medium 20 into the gap between the back-plate electrode roller 22 and the aperture electrode body 1. The back-plate electrode roller 22 is connected to a DC source 24 capable of applying a voltage of +1 kV to the back-plate electrode roller 22.

A recording medium conveyer unit includes a pair of conveying rollers (not shown), and the fixation device 26. The image recording medium 20 is inserted through an insert opening (not shown), and clamped and conveyed by the conveying rollers to the fixation device 26, passing through the position of the back-plate electrode roller 22, that is, the image forming position. The fixation device 26 is a thermal fixation roller device substantially made up of a heat roller 26A having a built-in heat source, for example, a halogen heater, and a pressure roller 26B pressed against the heat roller 26A and having a silicon rubber surface layer. After toner is deposited on the image recording medium 20 so as to form an image (hereinafter, referred to as "toner image"), the image recording medium 20, carrying the toner image thereon, is clamped by the two rollers 26A, 26B of the fixation device 26 so that the toner image is thermally fixed. Subsequently, the image recording medium 20 is discharged from a discharge opening (not shown) to outside the image forming apparatus 50.

The operation of the image forming apparatus 50 will now be described. When an image forming instruction is inputted to the image forming apparatus 50 from an external device (not shown), the toner carrying roller 14 and the supply roller 12 are started to rotate in the directions indicated by the arrows in FIG. 2. Therefore, toner 16 is supported on the surface of the supply roller 12, and then rubbed on the surface of the toner carrying roller 14 and negatively charged so that the toner 16 becomes supported on the surface 14A of the toner carrying roller 14. The supported toner 16 is then uniformly spread into a thin layer and charged substantially uniformly by the toner layer restriction blade 18, and then transported toward the aperture electrode body 1 by rotation of the toner carrying roller 14. The toner 16 on the toner carrying roller 14 is then supplied to a position below the apertures 6, rubbing along the insulating sheet 2 of the aperture electrode body 1.

The image recording medium 20 is clamped and conveyed by the conveying rollers toward the gap between the aperture electrode body 1 and the back-plate electrode roller 22. Subsequently, voltage is applied to the control electrodes 4. More specifically, the on-voltage (+20 V) is applied from a control power source (not shown) to the control electrodes 4 located in print portions. The off-voltage (−20 V) is similarly applied to the control electrode 4 located in non-print portions. While the on-voltage (+20 V) is applied to a control electrode 4, the electric potential difference between the control electrode 4 and the toner carrying roller 14 produces a flux of electric force in the direction from the control electrode 4 to the toner carrying roller 14. Therefore, the negatively-charged toner 16 receives an electrostatic force in the direction of increasing potential, whereby the toner 16 is drawn from the toner carrying roller 14 toward the control electrode 4, passing through the aperture 6. The thus-drawn toner 16 flies toward the image recording medium 20, due to the electric field produced between the image recording medium 20 and the aperture electrode body 1. As a result, the toner 16 lands and deposits on the image recording medium 20, thereby forming a pixel.

When the off-voltage (−20 V) is applied to a control electrode 4, a flux of electric force from the toner carrying roller 14 to the control electrode 4 is produced. Therefore, the negatively-charged toner 16 receives an electrostatic force in such a direction as to be pressed against the toner carrying roller 14. Thus, the toner 16 does not pass through the aperture 6.

While one line of pixels are formed on the surface of the image recording medium 20 by toner 16, the image recording medium 20 is conveyed in a direction perpendicular to the line of the apertures 6 by a distance of one pixel by the recording medium conveyer unit. By repeating this process, a desired toner image is formed on the entire surface of the image recording medium 20.

The thus-formed toner image is then fixed to the image recording medium 20 by the fixation device 26. Finally, the image recording medium 20 is discharged form the discharge opening (not shown) to outside the image forming apparatus 50.

Images are formed using toner by the process described above. The invention provides numerous advantages. Specifically, the use of the aperture electrode body provided with driver ICs formed from low-temperature polycrystal silicon makes it possible to form the driver ICs directly on the substrate. Therefore, the step of mounting and connecting driver ICs onto a substrate is eliminated, which solves the problem of connection reliability. Furthermore, the low-temperature polycrystal silicon enables or facilitates production of a highly-integrated recording head having a high-density pitch, that is, a 100-$\mu$m pitch (250 dpi) or a higher-density pitch, for example, a 300-dpi recording head as mentioned above. Consequently, it becomes easy to form a high-resolution aperture electrode body and reduce costs.

It is to be understood that the invention is not restricted to the particular forms shown in the above-described embodiment. Various modifications and alternations can be made thereto without departing from the scope of the invention.

Although in the above-described embodiment, polyimide resin is used to form the substrate of the aperture electrode body 1, the substrate material is not limited to such an organic material. It is also possible to use a ceramic material such as zirconia, alumina and the like, a silicon material, a glass material, and the like as the material of the substrate.

Although in the above-described embodiment, the formation of the print portion, such as the apertures, is performed after the driver ICs 5 are formed on the substrate, it is also possible to form driver ICs after formation of the print portion.

Although the foregoing embodiment is described in conjunction with toner, that is, a dry powder, the invention may be applied to any printing material whose particles are charged, for example, liquid developer such as liquid toner, charged ink, and the like. Such an application of the invention also achieves many advantages.

Although the above-described embodiment is described in conjunction with a mono-color print unit, it should be apparent that the invention is applicable to a color print device or similar device wherein a plurality of print units are arranged.

Although in the above-described embodiment, the control electrodes 4 are provided on one side of the insulating sheet 2 of the aperture electrode body 1, that is, the side facing the image recording medium 20, it is also possible to provide the control electrodes 4 on the side facing the toner carrying roller 14, or alternatively on both sides.

What is claimed is:

1. A recording electrode body for use with, and disposed between, a charged particle supply device that supplies charged particles and a back-plate electrode device that draws the charged particles, the recording electrode body restricting flight of the charged particles supplied by the charged particle supply device, the recording electrode body comprising:

a flexible resin insulating sheet that defines a plurality of apertures so that the charged particles can pass through the apertures;

a control electrode that controls passage of the charged particles through the apertures by using an electric field; and a driver IC disposed directly on the insulating sheet, the driver IC controlling production of the electric field by the control electrode.

2. The recording electrode body according to claim 1, wherein the driver IC is formed from a low-temperature polycrystal silicon.

3. The recording electrode body according to claim 2, wherein the driver IC is a driver IC formed from the low-temperature polycrystal silicon by forming a thin film of an amorphous silicon on the insulating sheet, polycrystallizing the thin film of the amorphous silicon, and converting the polycrystallized amorphous silicon into a semiconductor circuit.

4. The recording electrode body according to claim 3, wherein the insulating sheet is formed from a polyimide resin, and the charged particles are toner particles.

5. The recording electrode body according to claim 1, wherein the driver IC sends the control electrode an electrical signal corresponding to information to be recorded, and is formed on the insulating sheet.

6. The recording electrode body according to claim 1, wherein at least one of the control electrode and the plurality of apertures are provided on the insulating sheet at a density of at least 250 dpi.

7. An image forming apparatus, comprising:

a charged particle supply device that supplies charged particles;

a back-plate electrode device that draws the charged particles; and a recording electrode body disposed between the charged particle supply device and the back-plate electrode device, the recording electrode body restricting flight of the charged particles supplied by the charged particle supply device, the recording electrode body including:

a flexible resin insulating sheet that defines a plurality of apertures so that the charged particles can pass through the apertures, a control electrode that controls passage of the charged particles through the apertures by using an electric field, and a driver IC disposed directly on the insulating sheet, the driver IC controlling production of the electric field by the control electrode.

8. The image forming apparatus according to claim 7, wherein the driver IC is formed from a low-temperature polycrystal silicon.

9. The image forming apparatus according to claim 8, wherein the driver IC is a driver IC formed from the low-temperature polycrystal silicon by forming a thin film of an amorphous silicon on the insulating sheet, polycrystallizing the thin film of the amorphous silicon, and converting the polycrystallized amorphous silicon into a semiconductor circuit.

10. The image forming apparatus according to claim 9, wherein the insulating sheet is formed from a polyimide resin, and the charged particles are toner particles.

11. The image forming apparatus according to claim 7, wherein the driver IC sends the control electrode an electrical signal corresponding to information to be recorded, and is formed on the insulating sheet.

12. The image forming apparatus according to claim 7, wherein at least one of the control electrode and the plurality of apertures are provided on the insulating sheet at a density of at least 250 dpi.

13. A method of manufacturing a recording electrode body for use with, and disposed between, a charged particle supply device that supplies charged particles and a backplate electrode device that draws the charged particles, the recording electrode body restricting flight of the charged particles supplied by the charged particle supply device, the method comprising the steps of:

defining a plurality of apertures in a flexible resin insulating sheet so that the charged particles can pass through the apertures;

providing a control electrode that controls passage of the charged particles through the apertures by using an electric field; and positioning a driver IC directly on the insulating sheet so that the driver IC controls production of the electric field by the control electrode.

14. The method of manufacturing a recording electrode body according to claim 13, further including the step of forming the driver IC from a low-temperature polycrystal silicon.

15. The method of manufacturing a recording electrode body according to claim 14, wherein the step of forming the driver IC includes the steps of forming a thin film of an amorphous silicon on the insulating sheet, polycrystallizing the thin film of the amorphous silicon, and converting the polycrystallized amorphous silicon into a semiconductor circuit.

16. The method of manufacturing a recording electrode body according to claim 15, further including the step of forming the insulating sheet from polyimide resin.

17. The method of manufacturing a recording electrode body according to claim 13, further including the step of positioning the driver IC directly on the insulating sheet so as to be able to send the control electrode an electrical signal corresponding to information to be recorded.

18. The method of manufacturing a recording electrode body according to claim 13, further including the step of providing at least one of the control electrode and the plurality of apertures on the insulating sheet at a density of at least 250 dpi.

* * * * *